US006454112B1

(12) United States Patent
Walters et al.

(10) Patent No.: US 6,454,112 B1
(45) Date of Patent: Sep. 24, 2002

(54) CARGO CONTAINERS

(75) Inventors: Graham John Lawrence Walters, London; Mark Steven Ford, Farnborough, both of (GB)

(73) Assignee: Air Cargo Equipment (UK) Limited, Middlesex (GB)

( * ) Notice: Subject to any disclaimer, the term of this patent is extended or adjusted under 35 U.S.C. 154(b) by 0 days.

(21) Appl. No.: 09/553,540

(22) Filed: Apr. 20, 2000

(30) Foreign Application Priority Data

Apr. 21, 1999 (GB) ..... 9909181

(51) Int. Cl.[7] ..... B65D 88/00
(52) U.S. Cl. ..... 220/1.5; 220/668
(58) Field of Search ..... 220/1.5, 9.1, 660, 220/668

(56) References Cited

U.S. PATENT DOCUMENTS 2,685,398 A * 8/1954 King ..... 220/1.5 X
3,623,631 A * 11/1971 Ford ..... 220/1.5 X
4,144,984 A * 3/1979 Saunders ..... 220/1.5
4,577,772 A * 3/1986 Bigliardi ..... 220/1.5
4,660,724 A * 4/1987 Gaynes ..... 220/1.5 X
4,662,669 A * 5/1987 Erickson et al. ..... 220/1.5 X
4,747,504 A * 5/1988 Wiseman et al. ..... 220/1.5
5,031,776 A * 7/1991 Morgan, IV ..... 220/1.5 X
5,111,950 A * 5/1992 Wylenzek ..... 220/1.5
5,378,106 A * 1/1995 Risley et al. ..... 220/1.5 X
5,395,682 A * 3/1995 Holland et al. ..... 220/1.5 X

FOREIGN PATENT DOCUMENTS

| | | |
|---|---|---|
| EP | 0 084 942 A1 | 8/1983 |
| GB | 1097040 | 12/1967 |
| WO | 97/36802 A1 | 10/1997 |

* cited by examiner

*Primary Examiner*—Steven Pollard
(74) *Attorney, Agent, or Firm*—Renner, Otto, Boisselle & Sklar, LLP

(57) ABSTRACT

A cargo container includes two tine tunnels disposed at the top of the container, for receiving the tines of a fork-lift truck. The tine tunnels fit between upper and lower header extrusions and a protection plate is provided to protect the container from the fork tines. Lifting the container at the top, rather than at the bottom, improves loading stability and minimizes container damage.

6 Claims, 2 Drawing Sheets

CARGO CONTAINERS

BACKGROUND OF THE INVENTION

1. Field of the Invention

This invention relates to cargo containers, and particularly but not exclusively to cargo containers to be carried by aircraft.

2. Description of the Prior Art

Cargo containers, particularly for use in aircraft, can be heavy when laden, and it is standard practice for the containers to be loaded into aircraft, and otherwise moved, by means of forklift trucks. A problem that can arise is that the tines of the forks can damage the container structure. Another problem is that the stability during loading can be poor, since the center of gravity of the container will be significantly above the level of the tines.

SUMMARY OF THE INVENTION

It is an object of the present invention to provide a cargo container in which the stability during loading is improved over that of the prior art.

It is another object of the present invention to provide a cargo container in which the container structure has improved protection against damage caused by the tines of a forklift truck.

According to the invention there is provided a cargo container comprising means for receiving tines of a fork-lift truck, the receiving means being mounted adjacent the top of the container.

A preferred embodiment of the invention provides a particularly advantageous arrangement in that tine tunnels are provided at the top of the container, and therefore damage to the container of the cargo is minimized since the tines are retained within the tunnels. The gaps between the tunnels are left open so as to maximize cargo volume and to reduce hidden areas for contraband. Since the fork tines lift the container at its top, the stability of loading is improved compared to bottom engagement by the fork tines. Also, due to the tine tunnels being located at the top of the container, it is very difficult, if not impossible, to stack such containers more than two containers high, when using standard type forklift trucks, thus alleviating possible damage which would be caused by placing more than one loaded container on top of another, This also reduces the potential instability of container stacks, thus reducing the risk of injury or death to freight yard personnel. A further advantage of the design is that it is easier for the forklift truck operator to align the fork tines with the tine tunnels since these are (at least substantially) at eye level.

BRIEF DESCRIPTION OF THE DRAWINGS

In order that the invention may be better understood, including its objects, features and advantages, a preferred embodiment will now be described by way of illustrative and non-limiting example with reference to the accompanying drawings, in which.

DESCRIPTION OF THE PREFERRED EMBODIMENTS

Figure 1:
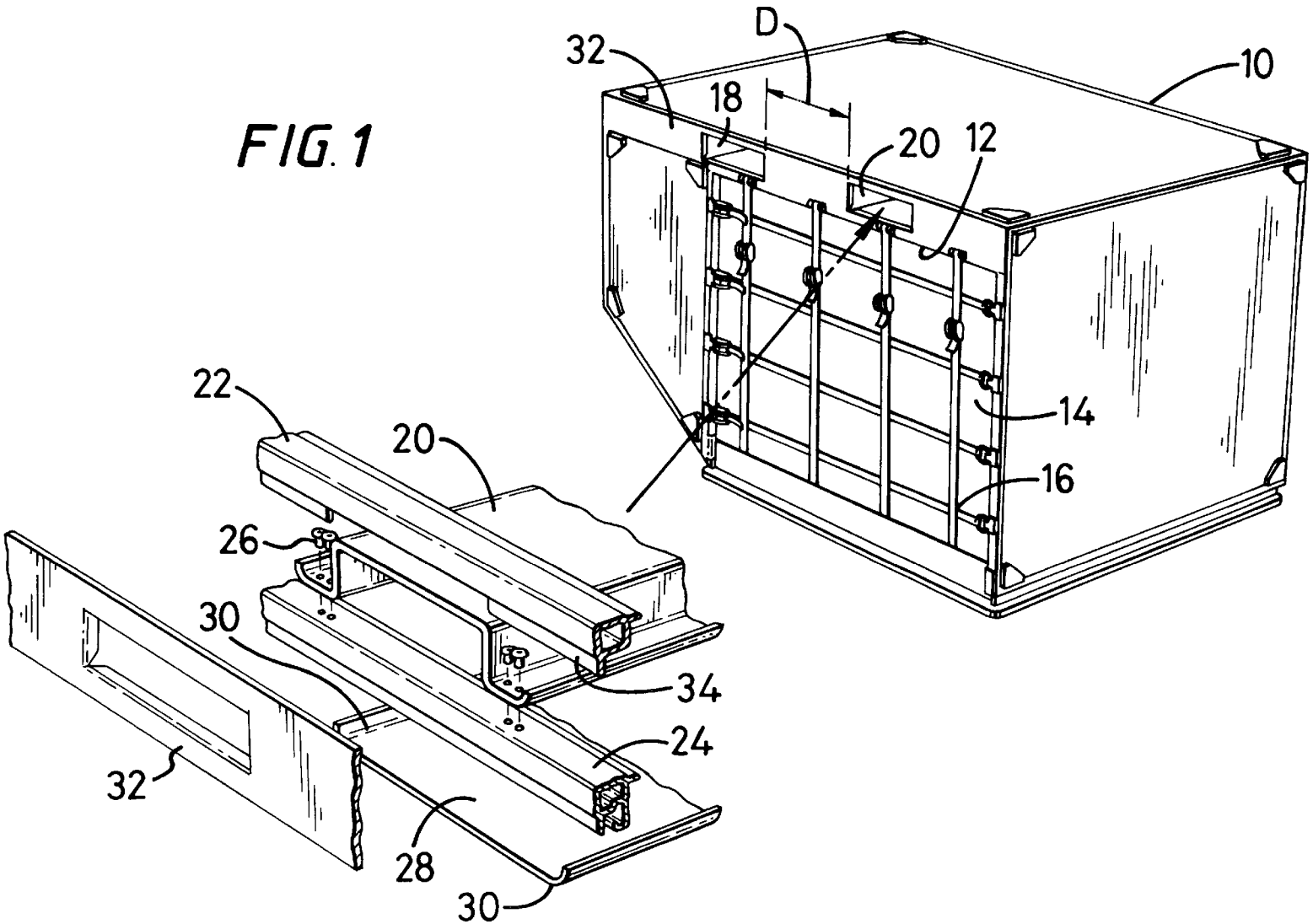
FIG. 1 is a perspective view of a cargo container in accordance with one embodiment of the invention, with certain parts shown enlarged in detail.

Referring firstly to FIG. 1 of the drawings, a cargo container 10 is constructed in standard fashion by means of a reinforcing framework structure, generally of aluminum alloy with steel reinforcing gussets in high stress areas, covered with plates of suitable material, which may be aluminum alloy cladding or some different custom material. An opening 12 is provided in one side, for loading purposes, and this retains a cover 14 held in place by a webbing arrangement 16. Thus far, the construction as described is standard. In accordance with the preferred embodiment of the invention, two tine tunnels 18, 20 are provided adjacent the top of the container, these being preferably made of aluminum alloy. It will be clear from the enlarged detail that the tine tunnels 18, 20 are supported between a standard header extrusion 22 joining the top part of the framework of the container 10) and an additional lower header extrusion 24 attached to the side parts of the framework, as with the standard header extrusion 22. The tine tunnels 18, 20 are preferably attached to the lower header extrusion 24 by suitable fasteners 26 such as rivets. Any other suitable form of fastening can be used instead. The tine tunnels 18, 20 have outwardly-facing flanges and these provide attachment points for the fasteners 26 to attach to the lower header extrusion 24. A similar additional lower header extrusion (not shown) is also provided at the rear of the container 10. In order to provide further protection, a tine tunnel bottom cover 28 is attached to each tine tunnel 18, 20 so as to encase the fork tines completely when inserted. The bottom cover 28 preferably has a rolled edge 30 at each side for headstrike protection. The extrusion and the bottom cover 28 are preferably made of aluminum alloy.

In order to protect the structure of the container 10, a protection plate 32, preferably of steel or other strong material, is positioned over the tine tunnels 18, 20, suitable apertures being provided in the protection plate 32 so as to align with the openings of the tine tunnels 18, 20.

The header extrusion 22 may, as shown, include a flange 34 directed downwards. In order to provide good location of the tine tunnels 18, 20, the flange 34 may have an opening sized to receive the tine tunnels 18, 20.

The spacing D between the tine tunnels 18, 20 is arranged to allow standard-spaced forked tines to be received, in accordance with the specification AHM912.

Figure 2:
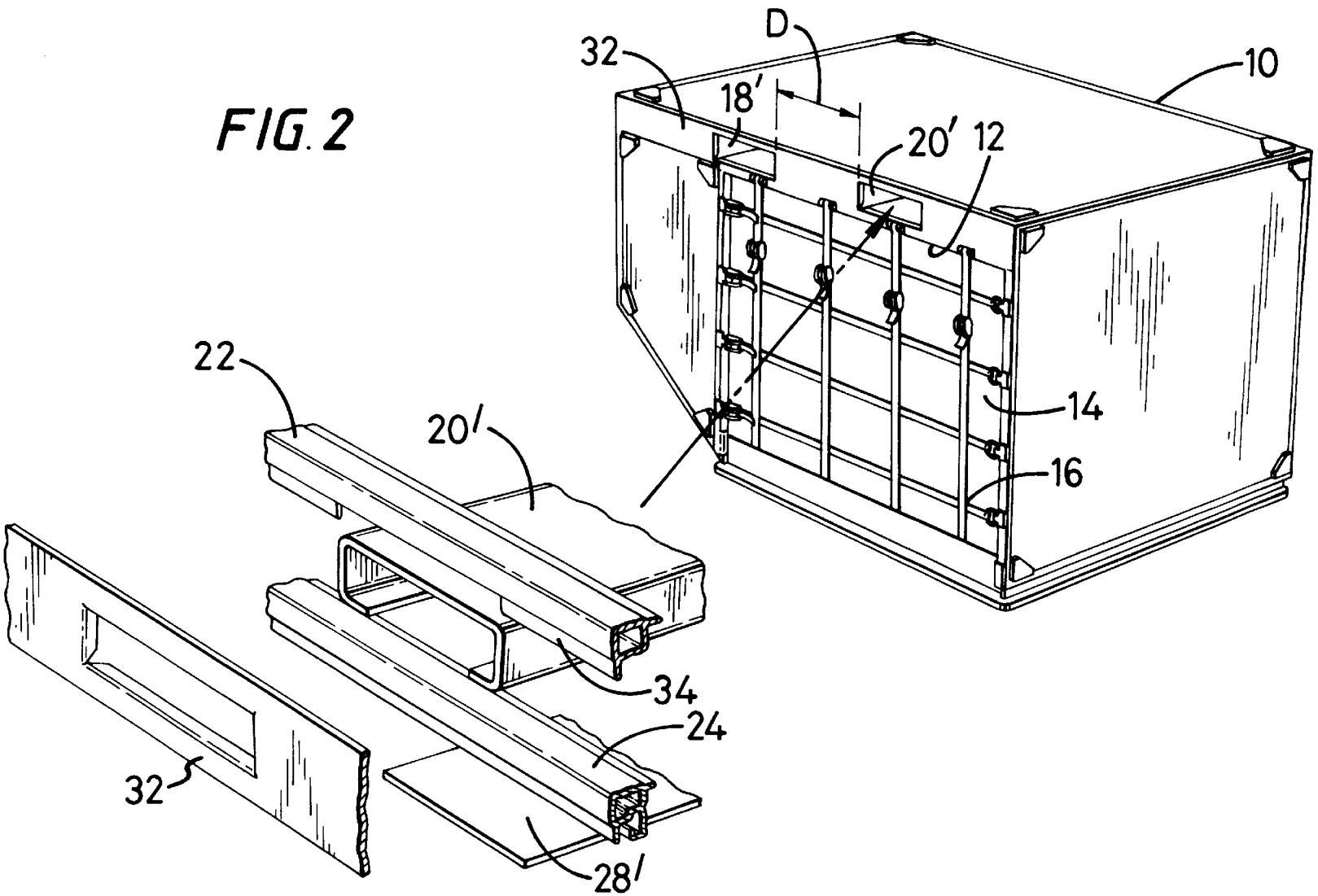
FIG. 2 is a view similar to that of FIG. 1, but showing another embodiment of the invention.

FIG. 2 shows a different version which has additional advantages over the arrangement shown in FIG. 1. Referring to FIG. 2, parts which are the same as those in FIG. 1 are given the same reference numerals. The cargo container 10 shown in FIG. 2 differs from that previously described in that the two tine tunnels 18', 20' have inwardly-facing flanges at the bottom, for attachment by suitable means to the lower header extrusion 24. One advantage of the inwardly-directed flanges of the tine tunnels 18', 20' is that manufacture is simplified. Another advantage of this arrangement is that the potential for headstrike damage while loading the container is minimized. In this version, the tine tunnel bottom cover 28' can be flat as shown, since rolled edges are not required.

What is claimed is:

1. An air cargo container comprising:

an reinforcing framework structure including an upper mounting member forming the top of said framework structure;

cladding covering said framework structure;

two tine tunnels extending into the container adjacent the top, each of said tine tunnels being closed off at the bottom by a respective bottom cover; and a lower mounting member parallel to and disposed near said upper mounting member such that said tine tunnels are sandwiched between and supported by said upper and lower mounting members.

2. A cargo container according to claim 1, wherein each tine tunnel has inwardly-facing flanges at the bottom thereof.

3. A cargo container according to claim 1, wherein each tine tunnel has outwardly-facing flanges at the bottom thereof.

4. A cargo container according to claim 1, wherein each tine tunnel bottom cover has rolled edges.

5. A cargo container according to claim 1, including a protection plate provided with apertures, the protection plate covering the tine receiving means but allowing access thereto via the apertures.

6. A cargo container according to claim 1, wherein the only tine tunnels in the cargo container are the said tine tunnels located adjacent the top of the framework structure.

* * * * *